United States Patent [19]

Sarkissian

[11] 4,416,072

[45] Nov. 22, 1983

[54] HEEL AND SOLE ASSEMBLY FOR AN ADJUSTABLE ARCH SHOE

[75] Inventor: Vahé Sarkissian, Paris, France

[73] Assignee: Touchwood International S.A., Geneva, France

[21] Appl. No.: 304,573

[22] Filed: Sep. 22, 1981

[30] Foreign Application Priority Data

Oct. 9, 1980 [FR] France ..... 80 21611

[51] Int. Cl.[3] ..... A43B 3/24; A43B 13/28; A43B 21/36

[52] U.S. Cl. ..... 36/100; 36/24.5; 36/42

[58] Field of Search ..... 36/24.5, 34 R, 42, 71.5, 36/72 B, 100, 101

[56] References Cited

U.S. PATENT DOCUMENTS

| | | | |
|---|---|---|---|
| 2,184,209 | 12/1939 | Burger | 36/8.5 |
| 2,258,265 | 10/1941 | Schwartz | 36/100 |
| 2,509,423 | 5/1950 | Cramer | 36/2.5 |
| 2,707,341 | 5/1955 | Romano | 36/100 |
| 2,934,840 | 5/1960 | Mistarz | 36/34 R |
| 3,464,126 | 9/1969 | Sarkissian | 36/100 |

FOREIGN PATENT DOCUMENTS

| | | |
|---|---|---|
| 1129086 | 5/1962 | Fed. Rep. of Germany . |
| 4960 | 5/1979 | Fed. Rep. of Germany . |

*Primary Examiner*—Patrick D. Lawson

*Attorney, Agent, or Firm*—Scully, Scott, Murphy & Presser

[57] ABSTRACT

The invention relates to a heel and sole assembly for an adjustable arch shoe. The assembly comprises a fixed nondeformable support element forming a heel portion and a sole portion, a pivoting element which covers a rear portion of the sole and heel portions and which is articulated upon the sole through an axis which is perpendicular to the length of the shoe so as to pivot between a lowered position and one or more elevated positions, a locking element to lock the pivoting element in any one of its positions and a prestressed spring arranged between the fixed support element and the pivoting element to force the latter upwardly to a desired elevated position. Such an assembly makes it possible to instantly change the heel height of the shoe without removal of the shoe from the wearer's foot.

2 Claims, 5 Drawing Figures

HEEL AND SOLE ASSEMBLY FOR AN ADJUSTABLE ARCH SHOE

FIELD OF THE INVENTION

The present invention relates to a heel and sole assembly for a shoe, capable of instantly being set to whatever position the wearer desires and in such a manner as to vary the height of the heel and the arch of the sole.

BACKGROUND OF THE INVENTION

Shoes having height adjustable heels are known in which the change in height is obtained by adding a separate element within the interior of the shoe or at the end of the heel or by a height-adjustable telescopic arrangement. The wearer must constantly be in possession of the separate height-adjusting element and must make sure it has not been left behind when going out. Furthermore, the insertion and the removal of this element or the adjustment of the telescopic system are relatively time consuming and are relatively delicate operations which require the wearer to remove the shoes and remain in an uncomfortable position during the adjustment period. Moreover, in the particular case of adjustment by means of a telescopic system, the heel and sole assembly is tilted as the unit upwards or downwards in relation to its initial position, as the heel is respectively lowered or raised. Therefore, the sole is no longer applied flat against the ground, but is inclined upwards or downwards. A feeling of discomfort for the wearer and a rapid tiring of the feet is the result from this inclination.

According to U.S. Pat. No. 3,464,126, moreover a shoe having a height-adjustable heel is known which does not present the abovementioned disadvantages. This shoe comprises a fixed support element forming the heel and sole, a pivoting element positioned above the rear part of the fixed element and articulated upon the latter in such a way that it can be raised or lowered in relation to the fixed element by means of manually activating the locking mechanism which is intended to lock the pivoting piece in the position corresponding to the height chosen for the heel, and a prestressed spring means is arranged between the fixed support element and the pivoting element and is intended to pull the latter towards its elevated position.

The locking mechanism is made up of two linch pins transversally mounted in an opening formed in the fixed support element of the shoe, said linch pins being pulled by a spring towards the outside so as to penetrate into pairs of receptor openings vertically positioned on two lateral sides protruding under the pivoting element and overlapping the fixed support element.

To release said linch pins from the receptor openings into which they protrude, there is provided on the overlapping sides of the pivoting element, two knobs provided with studs penetrating into said pairs of receptor openings and capable of withdrawing said linch pins from the receptor openings when the knobs are simultaneously pressed in. The pivoting element is then released and can be placed in another position for which the pins penetrate into another pair of receptor openings.

Although operating in a satisfactory manner, such a locking mechanism cannot in practice be used by reason of it unaesthetic appearance. The knobs and overlapping sides are visible on both sides of the shoe so that they cannot be used for the manufacture of shoes that bear fine brands. Furthermore, the heel of the pivoting element overhangs the fixed support element.

SUMMARY OF THE INVENTION

The present invention has for its purpose the elimination of these drawbacks and, to achieve this, has for its object a heel and sole assembly for an adjustable arch shoe of the type already mentioned and which is characterized in that the pivoting element comprises a hollow structure heel body covering the heel of the fixed piece with sufficient clearance so as to be able to slide without rubbing along said heel when said pivoting element rotates and a sole body articulated upon the fixed element on a level with the zone of inflection of the sole's arch, said locking means being made up of only one axially sliding mounted pin, counter to the force of a spring, positioned within a horizontal recessed opening provided in the internal vertical face of the fixed heel, the external end of said pin protruding through one of several openings made upon the internal face of the heel body.

Said pin serves at the same time as a locking means for the pivoting element and a push button to release the latter, so that the locking mechanism is simplified in relation to the locking mechanism described in U.S. Pat. No. 3,464,126. Furthermore, the pin herein is completely hidden from sight since it scarcely protrudes from the internal face of the heel. Finally, in its lower position, the pivoting element rests along its entire surface upon the fixed element thus imparting a feeling of stability to the shoe.

BRIEF DESCRIPTION OF THE DRAWING

One embodiment of the invention will now be described in detail, as a non-limiting example, with respect to the attached drawing in which.

DESCRIPTION OF THE PREFERRED EMBODIMENTS

Figure 1:
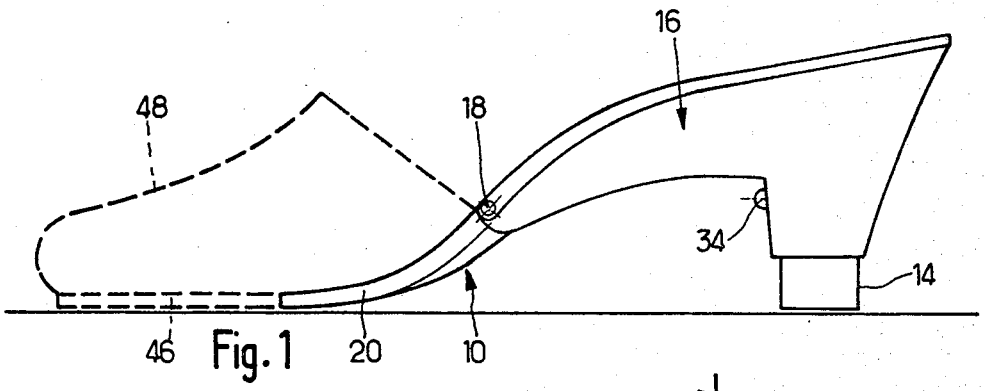
FIG. 1 is a view in lateral elevation of the heel and sole assembly according to the present invention.
Figure 3:
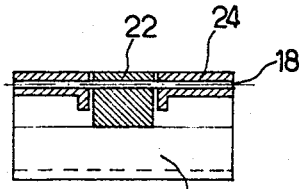
FIG. 3 is a cross-section following line III—III of FIG. 2.

With reference to the figures, the heel and sole assembly is composed of a fixed nondeformable element 10 comprising a sole 12 and a heel 14, and a pivoting element 16 covering the back part of sole 12 and heel 14, and articulated at its front edge along a horizontal axis 18 borne by sole 12 on a level with the zone of inflection between concave arch element 20 upon which the toes of the wearer's foot rest and convex arch element 22 upon which the plantar arch of the wearer's foot rests.

The pivoting element comprises an upper face 24 with the same configuration as rear sole element 22 which it covers and a hollow structure heel body 26 surrounding heel 14.

To avoid any extra thickness of sole 22, the latter presents a space 28 into which said face 24 fits exactly.

Figure 2:
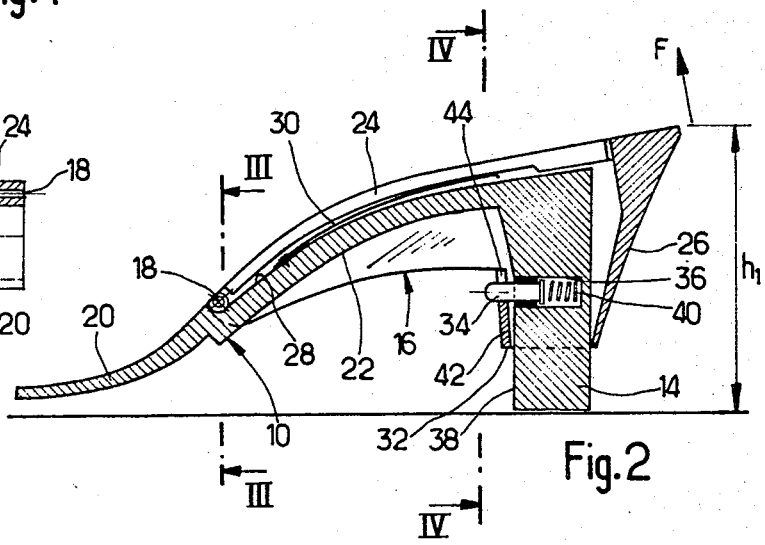
FIG. 2 is a longitudinal cross-section of said heel and sole assembly, the pivoting element being represented in its lowered position.
Figure 4:
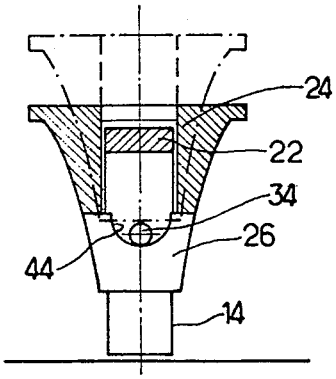
FIG. 4 is a cross-section following line IV—IV of FIG. 2.
Figure 5:
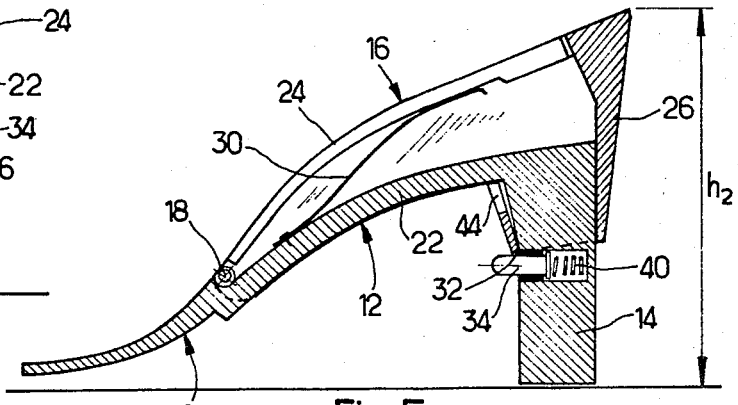
FIG. 5 is a view similar to FIG. 2, the pivoting element being shown in its elevated or upper position.

As FIGS. 2 and 5 clearly show, a plate spring 30 is inserted between face 24 and convex arch element 22 of the sole. The plate is fixed at one end to the sole and exerts upon element 16 a force F directed upwards, tending to make said element pivot about axis 18.

Heel body 26 and heel 14 are shaped in such a way that peripheral edge 32 of the heel body will be substantially in contact with the heel in all positions of the pivoting elements.

Locking means are provided to secure pivoting element 16 in one of several set positions.

By way of the example illustrated in FIGS. 2 and 5, these locking means are made up of an axially sliding pin 34, mounted inside a horizontal recessed housing 36 formed in internal vertical face 38 of heel 14. A helical release spring 40 is mounted between the internal end of the pin and the back of housing 36. At its internal end, the pin terminates in a retaining element intended to prevent its ejection. The external end of the pin protrudes from said housing and crosses one among several openings formed in internal face 42 of the heel body. In the case of FIGS. 2 and 5, internal face 42 comprises a single opening 44, positioned in such a way as to be opposite pin 34 when pivoting element 16 is in its lowest position (FIG. 2). Minimum heel height $h_1$ is thus obtained.

In order to change heel height, all one does is press pin 34. Element 16 thus being released for movement is forced upwardly by plate spring 30. Maximum heel height $h_2$ thus obtained is defined by the placing of heel body edge 32 is support on the button.

It is within the scope of this invention to provide face 42 of the heel body with several openings defining several intermediate heel heights between heights $h_1$ and $h_2$.

It will be noted that going from one heel height to another in this invention is a simple and immediate operation which does not require removal of the shoes from the wearer's feet or the addition or removal of an accessory height-adjusting element. From one position of the pivoting element to the other, the general arch of the sole changes automatically, but front portion 20 of the sole nevertheless retains an invariable position which is substantially tangent to the ground during this change therein obtaining for the wearer a feeling of comfort. Moreover, the locking mechanism is completely invisible and does not effect the aesthetics of the shoe.

The heel and sole assembly can be manufactured from any rigid and light material, for example, metal or a suitable plastic material. The pin is advantageously metallic, for example, stainless steel.

Advantageously, the heel and sole assembly such as described is one which is available in commerce. The user can adapt a supplementary sole 46 (FIG. 1) to the end of sole portion 20 and fix an upper 48 or thin straps in the desired shapes and colors.

What is claimed is:

1. A heel and sole assembly for an adjustable arch shoe of the type comprising a fixed support element having a heel portion and a sole portion, a pivoting element positioned above the rear part of the fixed support element and in spaced relation to said rear part so that it can be raised or lowered in relation to said fixed support element; manually operable locking means to lock the pivoting element in the position corresponding to the height chosen for the heel, and prestressed spring means positioned between the fixed support element and the pivoting element to force the latter upwards, characterized in that the pivoting element comprises a hollow structure heel body covering the heel portion of the fixed support with sufficient clearance that said hollow structure heel body can freely slide along said heel when said pivoting element rotates, and a sole body articulated upon said fixed support element on a level with the zone of inflection of the sole's arch, said locking means being made up of a single axially slidable pin mounted against the force of a spring, said spring positioned within a horizontally recessed opening formed in the internal vertical face of the heel portion of the fixed support element, the external end of said pin protruding through one of several openings formed on the internal face of said hollow structure heel body.

2. A heel and sole assembly according to claim 1 in combination with an upper fixed to said heel and sole assembly to form a shoe.

* * * * *